US011213849B2

(12) United States Patent
Choi

(10) Patent No.: US 11,213,849 B2
(45) Date of Patent: Jan. 4, 2022

(54) APPARATUS FOR COATING INNER SURFACE OF MEDICAL TUBE

(71) Applicant: Noanix Corporation, Cheongju-si (KR)

(72) Inventor: Hyung Joon Choi, Cheongju-si (KR)

(73) Assignee: Noanix Corporation, Cheongju-si (KR)

( * ) Notice: Subject to any disclaimer, the term of this patent is extended or adjusted under 35 U.S.C. 154(b) by 0 days.

(21) Appl. No.: 17/080,048

(22) Filed: Oct. 26, 2020

(65) Prior Publication Data

US 2021/0220864 A1 Jul. 22, 2021

(30) Foreign Application Priority Data

Jan. 21, 2020 (KR) ..... 10-2020-0008037

(51) Int. Cl.
*B05C 7/02* (2006.01)
*B05C 11/06* (2006.01)
*B05C 11/10* (2006.01)

(52) U.S. Cl.
CPC ..... *B05C 7/02* (2013.01); *B05C 11/06* (2013.01); *B05C 11/1039* (2013.01)

(58) Field of Classification Search
None
See application file for complete search history.

(56) References Cited

U.S. PATENT DOCUMENTS 7,597,937 B2 * 10/2009 Anderson ..... B05C 3/09 118/400
10,875,048 B2 * 12/2020 Surma ..... B05C 11/101
2006/0210699 A1 * 9/2006 Collins ..... B05C 13/02 427/2.1
2011/0014386 A1 * 1/2011 Dillon ..... B05C 3/12 427/430.1
2012/0315381 A1 * 12/2012 Mergner ..... B05C 5/02 427/8

FOREIGN PATENT DOCUMENTS

KR 10-1749743 B1 6/2017
KR 101749743 B1 * 6/2017 ..... B05C 3/02

* cited by examiner

*Primary Examiner* — Jethro M. Pence
(74) *Attorney, Agent, or Firm* — Knobbe Martens Olson & Bear LLP

(57) ABSTRACT

An apparatus for coating an inner surface of a medical tube includes a housing, an injection unit, a drying unit, and a supply unit. The housing defines an external shape of the apparatus and provides a workspace. The injection unit is positioned in an upper portion of the workspace and injects a coating fluid into a medical tube connected to a nozzle tip formed at a lower end thereof. The drying unit is positioned on the injection unit and dries the coating fluid introduced into the medical tube. The supply unit positioned in a lower portion of the workspace and collects a residual coating fluid discharged from a lower end of the medical tube and transfers the collected residual coating fluid to a supply valve of the injection unit. The apparatus can easily, uniformly, and efficiently coat the inner surface of a long medical tube such as a catheter.

6 Claims, 3 Drawing Sheets

APPARATUS FOR COATING INNER SURFACE OF MEDICAL TUBE

CROSS REFERENCE TO RELATED APPLICATION

The present application claims priority to Korean Patent Application No. 10-2020-0008037, filed Jan. 21, 2020, the entire contents of which is incorporated herein for all purposes by this reference.

BACKGROUND

1. Field

The present disclosure relates to an apparatus for coating an inner surface of a medical tube. More particularly, the present disclosure relates to an apparatus for coating an inner surface of a long medical tube such as a catheter with a coating fluid.

2. Description of the Related Technology

In general, a catheter is a flexible medical tube for drawing a body fluid or for injecting a medication into a body cavity of a living organism.

When performing a procedure of inserting a long medical tube such as a catheter into a body cavity or organ, a medical tube with a rough or contaminated surface may cause an injury or inflammation on the inner wall or mucous membrane of the body cavity or organ. To address the foregoing, an apparatus for coating a medical tube may be provided.

Korean Patent No. 10-1749743 discloses a dip coater for applying a hydrophilic coating to the surface of a medical tube.

The disclosure of this section is to provide background information relating to the invention. Applicant does not admit that any information contained in this section constitutes prior art.

SUMMARY

The present disclosure provides a medical tube inner coating apparatus including a chamber with multiple nozzles and a hot air blower. The apparatus allows the inner surface of medical tubes such as catheters to be easily coated and a coating process can be carried out in one space, thereby increasing coating efficiency and reducing costs, resulting in an increase in productivity.

One aspect of the present invention provides an apparatus for coating a medical tube, the apparatus including: a housing defining an overall external form of the apparatus, having a door, and providing a workspace; an injection unit disposed in an upper portion of the workspace and equipped with a nozzle tip through which a coating fluid is injected into a medical tube connected to the nozzle tip formed at a lower end thereof; a dryer disposed on the injection unit and configured to dry the coating fluid injected into the medical tube; and a supply unit disposed in a lower portion of the workspace, configured to collect a residual coating fluid discharged from the medical tube, and connected to a supply valve of the injection unit to supply the coating fluid to the injection unit.

The injection unit may include: an injection chamber having multiple outlets that are through-hole openings formed at the bottom thereof; a supply valve provided on one side of the injection chamber and functioning to control flow of the coating fluid supplied from to the injection chamber; and multiple nozzle tips engaged with the respective outlets and configured to discharge the coating fluid contained in the injection chamber downward.

In addition, each of the nozzle tips may be composed of multiple-stage fitting wedges with respective cross-sectional sizes that gradually decrease toward a lower end thereof so that each of the nozzle tips can be press-fitted into various sizes of medical tubes.

The drying unit may include a hot air blower supplying hot air and compressed air; and a hot air duct connected to an upper end opening of the injection chamber to transfer the hot air from the hot air blower to the injection chamber.

The supply unit may include a recovery tank that stores the residual coating fluid discharged from the medical tube; a supply line connected between the recovery tank and the supply valve; and a supply pump provided between the recovery tank and the supply line to pump the coating fluid so that the coating fluid is supplied to the supply valve through the supply line.

The inner wall surface of the workspace may be equipped with a heating wire for drying the coating fluid coated on the inner surface of the medical tubes by directly applying radiant heat to the medical tubes connected to the respective nozzle tips of the injection unit.

With the structure described above, according to embodiments of the present invention, it is possible to easily coat the inner surface of a medical tube, increase the coating efficiency and reduce costs by performing the coating process on multiple medical tubes in one chamber, and to increase the productivity in manufacturing coated medical tubes.

DESCRIPTION OF EMBODIMENTS

Hereinafter, embodiments of the present invention will be described in detail with reference to the accompanying drawings so that those skilled in the art can easily carry out the present invention.

In one example, a dip coater for applying a hydrophilic coating to the surface of a medical tube is provided. This coater coats the surface of a medical tube by dipping the medical tube that is stretched in a case into a coating solution contained in a coating booth. This coater allows the coating process to be performed in one chamber, thereby increasing coating efficiency and reducing costs. Therefore, this dip coater has an advantage of increasing productivity when manufacturing coated medical tubes.

When coating with the dip coater, however, a medical tube may be narrowed through a coating process or causes stress to a patient during insertion of a medical tube into a body cavity. Nonetheless, coating a medical device may be necessary to provide a convenient and safe procedure to a patient. Specifically, a medical tube for an interventional procedure may require internal coating. Thus, the inner surface of a medical tube may need to be coated to ensure the antibacterial properties of a fluid and the stability of a medication.

Figure 1:
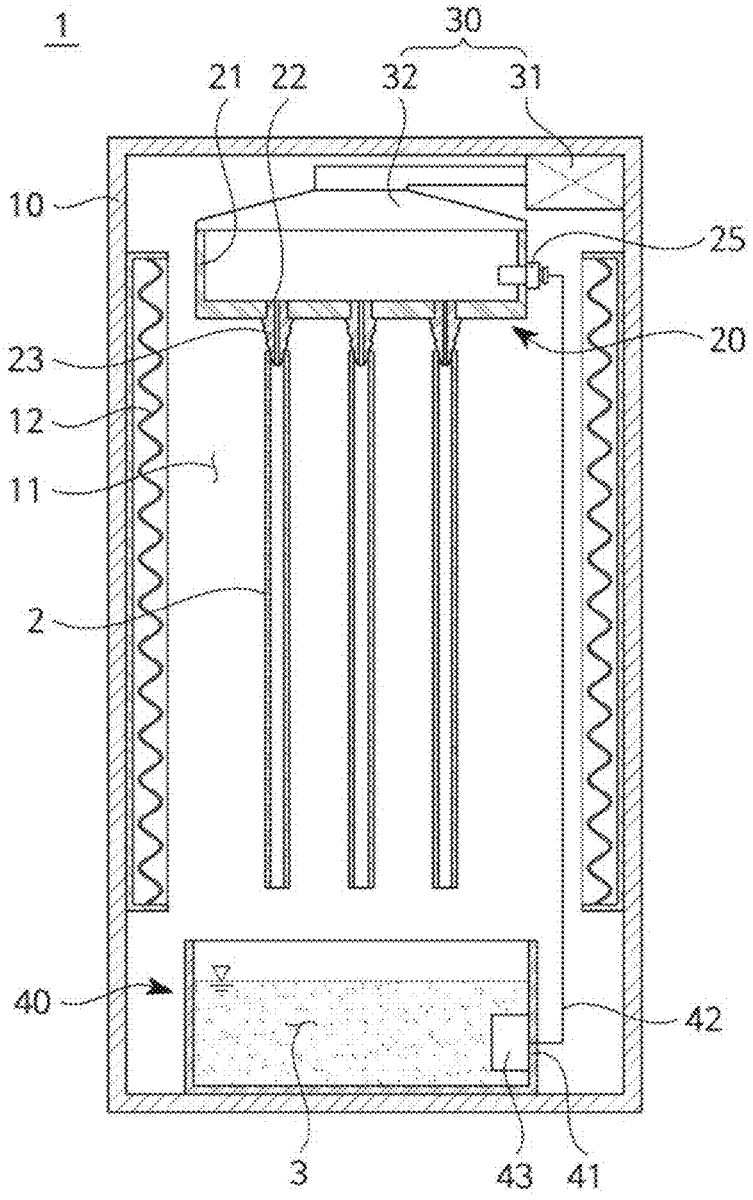
FIG. 1 is a diagram illustrating the construction of a medical tube coating apparatus according to one embodiment of the present invention.
Figure 2:
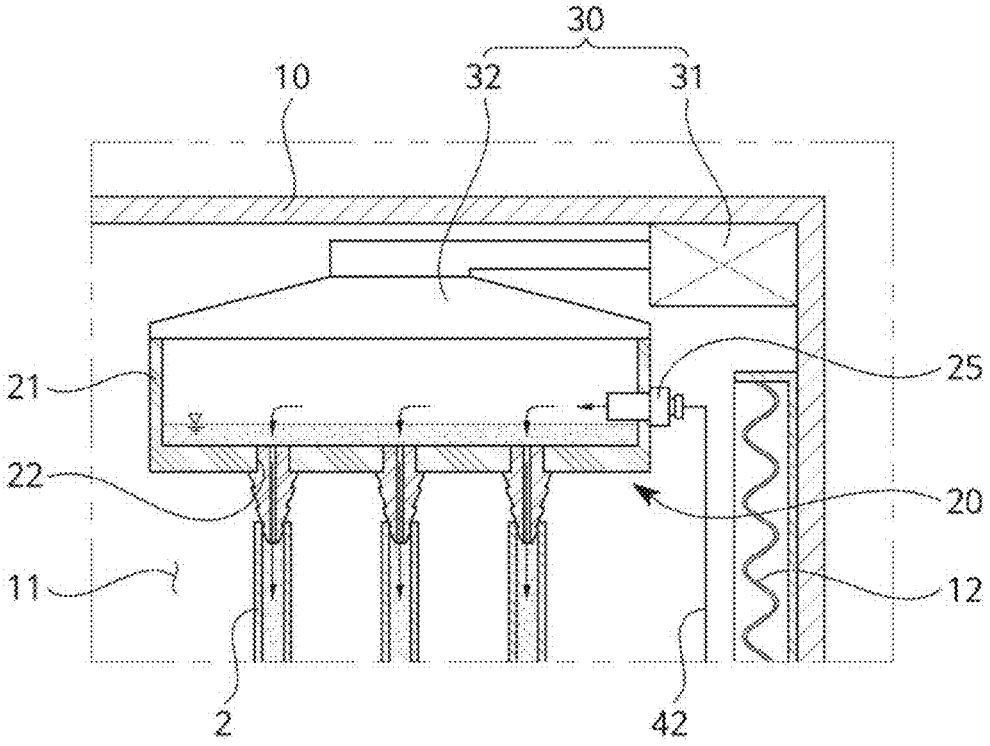
FIGS. 2 and 3 are diagrams illustrating operations of an injection chamber and hot air blower of the medial tube coating apparatus according to one embodiment of the present invention.
Figure 3:
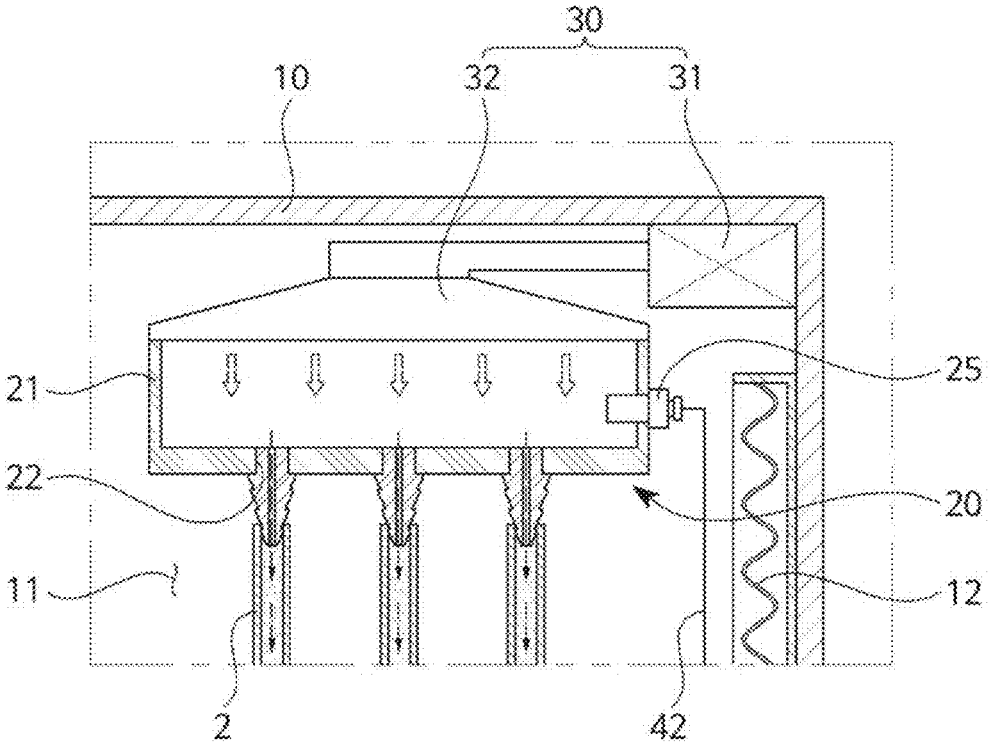

As shown in FIGS. 1 to 3, a medical tube coating apparatus according to embodiments of the present invention is an apparatus for coating the inner surface of a medical tube 2 such as a catheter. The apparatus can perform a process of applying a coating fluid 3 onto the inner surface of the medical tube 2 and a process of drying the applied coating fluid in one chamber, thereby reducing the costs for coating the medical tube.

Referring to FIG. 1, the coating apparatus 1 includes a housing 10 in which a workspace 11 is provided. The housing 10 has a front door.

To coat multiple medical tubes 2 that vertically extend in a center region of the workspace 11, an injection unit 20 for injecting a coating fluid 3, a drying unit 30 for drying the coating fluid 3, and a supply unit 40 for supplying the coating fluid 3 are provided in the workspace 11.

The injection unit 20 is positioned in an upper portion of the workspace 11. The injection unit 20 injects the coating fluid 3 into the medical tubes 2 connected to nozzle tips 23 formed at the bottom thereof.

The injection unit 20 includes an injection chamber 21, a supply valve 25, and the nozzle tips 23.

The injection chamber 21 is a box-shaped vessel with an open upper end. The bottom of the injection chamber 21 is provided with multiple outlets 22 that are through-hole openings.

The supply valve 25 is installed on a pipe line connected to one side of the injection chamber 21.

The supply valve 25 controls the flow of the coating fluid 3 supplied from the supply unit 40 to the injection chamber 21.

The nozzle tips 23 are coupled to the respective outlets 22 formed to pass through the bottom of the injection chamber 21.

The coating fluid 3 supplied to the injection chamber 21 through the supply valve 25 is discharged through the outlets 22 and is then injected into the medical tubes 2 engaged with the respective nozzle tips 23 and installed to vertically extend.

Each of the nozzle tips 23 has a multi-diameter wedge shape that tapers to the bottom so that various sizes of medical tubes can be connected to the nozzle tip 23 in a press-fitted manner.

There are many existing medical tubes 2 that vary in diameter. Since the nozzle tip 23 has a multi-diameter wedge shape, various sizes of medical tubes 2 can be easily connected to the nozzle tip 23 in a press-fitted manner.

After the upper ends of the medical tubes 2 are connected to the respective nozzle tips 23, the coating fluid 3 is injected into the interior of the medical tubes 2 through the nozzle tips 23.

In embodiments, the drying unit 30 may be disposed above the injection unit 20.

The drying unit 30 dries the coating fluid 3 coated on the inner surface of each of the multiple medical tubes 2 with hot air. The drying is the final step of the medical tube inner coating.

The drying unit 30 includes a hot air blower 31 that can produce and supply hot air and compressed air and which is installed inside the housing 10.

The drying unit 30 further includes a hot air duct 32 that is connected between the hot air blower 31 and the upper opening of the injection chamber 21 so that the hot air produced by the hot air blower 31 can be transferred to the injection chamber 21.

In addition, the inner wall surface of the workspace 11 is provided with a heating wire 12 that dries the coating fluid 3 coated on the inner surface of each medical tube 2 by directly applying radiant heat to the medical tubes 2 vertically extending from the respective nozzle tips 23 of the injection unit 20.

Due to the hot air supplied by the hot air blower 31 and the radiant heat of the heating wire disposed on the wall surface, it is possible to rapidly dry the coating fluid, thereby reducing the time required for the inner coating process.

In embodiments, the temperature of the hot air supplied by the hot air blower does not exceed 60° C. to prevent plastic deformation of the medical tubes 2 during the drying step.

In addition, the hot air blower 31 may be equipped with a fan for increasing the velocity of the hot air supplied to the injection unit or an air compressor for compressing air.

A supply unit 40 is disposed in a lower portion of the workspace 11. The supply unit 40 collects a coating fluid discharged from the lower end of the medical tube 2 and transfers the collected coating fluid to the injection unit 20 through a supply pipe 42 and a supply valve 25.

The supply unit 40 includes: a recovery tank 41 storing the collected residual coating fluid 3 discharged from the lower end of the medical tube 2; the supply pipe 42 connected between the recovery tank and the supply valve 25; and a supply pump 43 provided between the recovery tank 41 and the supply pipe 42 to pump the collected residual coating fluid 3 so that the residual coating fluid 3 can be transferred to the supply valve 25 through the supply pipe 41.

When the level of the coating fluid in the recovery tank 41 is lower than a predetermined level due to the consumption of the coating fluid 3, the coating fluid is externally supplemented through an external supply pipe so that the level of the coating fluid in the recovery tank will be increased.

Referring to FIG. 2, when the coating fluid 3 is pumped up to the supply valve 25 by the supply pump, the door of the housing 10 is opened through operation of a manipulation switch, and then the coating fluid is supplied to the injection chamber 21. The coating fluid 3 introduced into the injection chamber 21 is naturally injected into the medical tubes 2 through the outlets and the nozzle tips 23 due to the gravity.

Referring to FIG. 3, after the coating fluid 3 is injected into the medical tubes 2 and is then coated on the inner surface of each of the medical tubes 2, the hot air generated by the hot air blower 31 is supplied to the injection chamber 21 through the hot air duct 32 and is then injected into the medical tubes 2. Thus, the coating fluid 3 on the inner surface of each medical tube 2 is primarily dried by the hot air. In addition, the coating fluid 3 on the inner surface of each medical tube 3 is secondarily dried by the radiant heat generated by the heating wire 12 disposed on the wall surface of the housing.

With embodiments of the present invention described above, the inner surface of a medical tube can be easily coated, and the coating process can be carried out in one chamber. Therefore, coating efficiency is increased and coating costs can be reduced, whereby coated medical tubes can be economically mass-produced.

It should be understood that the terms used in the specification and the appended claims should not be construed as being limited to general and dictionary meanings, but interpreted based on the meanings and concepts corresponding to technical aspects of the present invention on the basis of the principle that the inventor is allowed to define terms appropriately for the best description of his or her invention.

Accordingly, the configuration illustrated in the embodiments disclosed herein and the drawings is merely embodiments of the present invention, and is not intended to represent all the technical concepts of the present invention, and thereby it should be appreciated that there may exist various equivalents and modifications for substituting those at the time of filing this application.

What is claimed is:

1. An apparatus for coating an inner surface of a medical tube, the apparatus comprising:

a housing defining an external shape of the apparatus and having a door and a workspace;

an injection unit positioned in an upper portion of the workspace and configured to inject a coating fluid into at least one medical tube connected to at least one nozzle tip formed at a lower end thereof;

a drying unit positioned on the injection unit and configured to dry the coating fluid introduced into the medical tube; and a supply unit positioned in a lower portion of the workspace and configured to collect a residual coating fluid discharged from a lower end of the medical tube, the supply unit being connected to a supply valve disposed on a supply pipe connected to one side of the injection unit to transfer the collected coating fluid to the injection unit.

2. The apparatus according to claim 1, wherein the injection unit comprises:

an injection chamber having multiple outlets that are through-hole openings formed at a lower end thereof;

the supply valve provided on the supply pipe connected to the injection chamber and configured to control introduction of the coating fluid into the injection chamber from the supply pipe; and the at least one nozzle tip comprising multiple nozzle tips engaged with the respective outlets and configured to discharge the coating fluid contained in the injection chamber downward.

3. The apparatus according to claim 2, wherein the at least one medical tube comprises multiple medical tubes respectively connected to the multiple nozzle tips, and wherein each of the multiple nozzle tips has a multi-diameter wedge shape that tapers to a lower end thereof to facilitate a respective one of the multiple medical tubes to be easily fitted therein.

4. The apparatus according to claim 2, wherein the drying unit comprises:

a hot air blower configured to supply hot air and compressed air; and a hot air duct connected to an upper opening of the injection chamber to transfer the hot air generated by the hot air blower to the injection chamber.

5. The apparatus according to claim 1, wherein the supply unit comprises:

a recovery tank configured to store the residual coating fluid discharged from the lower end of the medical tube;

the supply pipe extending from the recovery tank to the supply valve; and a supply pump provided between the recovery tank and the supply pipe to pump the coating fluid so that the coating fluid is transferred up to the supply valve through the supply pipe.

6. The apparatus according to claim 1, wherein an inner wall surface of the workspace is provided with a heating wire to dry the coating fluid coated on the inner surface of the medical tube such that radiant heat is directly applied to the medical tube vertically extending from the nozzle tip of the injection unit.

* * * * *